US006244138B1

(12) United States Patent
Campbell

(10) Patent No.: US 6,244,138 B1
(45) Date of Patent: Jun. 12, 2001

(54) TORQUE REACTION DEVICE

(75) Inventor: Peter Joseph Campbell, Houston, TX (US)

(73) Assignee: Furmanite Worldwide, Inc., Richardson, TX (US)

( * ) Notice: Subject to any disclaimer, the term of this patent is extended or adjusted under 35 U.S.C. 154(b) by 0 days.

(21) Appl. No.: 09/145,169

(22) Filed: Sep. 1, 1998

(51) Int. Cl.[7] ..... B25B 17/00
(52) U.S. Cl. ..... 81/57.4
(58) Field of Search ..... 81/57.24, 57.4; 269/1, 287, 288, 909

(56) References Cited

U.S. PATENT DOCUMENTS

| | | | | |
|---|---|---|---|---|
| 4,155,279 | | 5/1979 | Zochert et al. | 81/57.39 |
| 4,287,795 | | 9/1981 | Curtiss . | |
| 4,629,157 | * | 12/1986 | Tsuchiya et al. . | |
| 4,696,197 | | 9/1987 | Hannel . | |
| 4,811,637 | | 3/1989 | McCleary . | |
| 4,885,962 | | 12/1989 | Summers | 81/57.31 |
| 5,367,924 | * | 11/1994 | Henson et al. | 81/57.4 |
| 5,467,674 | | 11/1995 | Thorn . | |
| 5,544,554 | | 8/1996 | Brightly . | |
| 5,579,801 | * | 12/1996 | Pye et al. . | |
| 5,580,021 | * | 12/1996 | Gillanders | 81/57.4 |
| 5,715,869 | | 2/1998 | Patterson . | |
| 5,924,442 | * | 7/1999 | Vorosmarti | 81/57.4 |

* cited by examiner

*Primary Examiner*—Eileen P. Morgan
*Assistant Examiner*—Joni B. Danganan
(74) *Attorney, Agent, or Firm*—Sidley & Austin

(57) ABSTRACT

A torque reaction device (16, 90, 110, 130, 150) is disclosed which can be used with a power wrench (14) to open and close a valve (10) in a valve assembly (12) which absorbs the shock of opening and closing the valve. The torque reaction device includes a torque reaction arm (18) which is mounted on the power wrench. A torque reaction frame (20, 94, 114, 132, 154) is provided which is mounted to the valve assembly in a manner dependant upon the configuration of the valve assembly. The torque reaction frame mounts a U-channel (22) which interacts with the torque reaction arm (18) to prevent uncontrolled movement of the power wrench relative to the valve while opening and closing the valve.

17 Claims, 11 Drawing Sheets

120
120
10
24
128
112
12
28
26
118
81
78
116
79
22
114
124
122
122
14
64
66
110
64

TORQUE REACTION DEVICE

TECHNICAL FIELD OF THE INVENTION

This invention relates to a torque reaction device, particularly for use with a nut runner tool.

BACKGROUND OF THE INVENTION

In industries where large valves are employed, it has been common practice to utilize pneumatic wrenches, such as a nut runner tool, to rotate valve hand wheels to reduce the physical effort required to operate the valves. The wrenches are typically applied to the nut at the center of the hand wheel. A shortcoming of the use of such wrenches occurs when the valve comes to the limit of travel. The powerful rotational torque delivered by the pneumatic wrench is suddenly transmitted to the body of the person operating the tool. Such a sudden application of force transmitted to the body has become a cause of lost time injuries to plant personnel.

Various efforts have been undertaken to overcome this problem. In one application, a massive piping substructure was constructed about a valve. A pneumatic wrench was permanently affixed to the piping substructure to operate the valve. This system was very cost prohibitive and required a dedicated pneumatic wrench for each valve location. A second concept was the use of a forked reaction arm attached to the pneumatic wrench. The arm was placed over a plate and pipe bracket welded to the decking adjacent to the valve. Unfortunately, the piping system often undergoes large cycles of thermal expansion and contraction, with resulting movement relative to the bracket mounted to the stationary deck structure. Also, the forked arm was long and when torque loads were applied to the arm it spread the slot open, necessitating the periodic replacement of the forked arm. A third system was a plate and U-shaped strap bracket bolted to the valve itself just behind the hand wheel. The U-shaped strap bracket allowed the wrench to be cradled in the U-shaped strap.

Despite these efforts, a need still exists for an apparatus and method for the control of sudden applications of force by such power wrenches.

SUMMARY OF THE INVENTION

In accordance with one aspect of the present invention, an apparatus is provided for use with a power wrench to open and close a valve in a valve assembly by rotating a valve stem about a first axis. The apparatus includes a frame member which is mounted on the valve assembly and defines at least one surface. An arm member is secured onto the power wrench. The arm member faces the surface on the frame member as the valve stem is rotated by the power wrench. Movement of the power wrench relative to the valve is limited by contact between the surface on the frame member and the arm member.

In accordance with another aspect of the present invention, the frame member includes a U-channel and the arm member is a blade extending parallel to and spaced from the elongate length of the power wrench. In accordance with another aspect of the present invention, at least one pin is incorporated to confine the arm member to movement within the U-channel. The frame member can have a clamp, with the frame member clamped to the valve assembly. The frame member can have a bracket, with the frame member bolted to the valve assembly at the bracket. The frame member can have a pair of clamps, with the valve assembly including a pipe section. The pair of clamps clamp the frame member to the pipe section.

BRIEF DESCRIPTION OF THE DRAWINGS

For a more complete understanding of the present invention and the advantages thereof, reference is now made to the following description, taken in conjunction with the accompanying drawings, in which.

DETAILED DESCRIPTION OF THE INVENTION

With reference now to the accompanying figures and the following detailed description, an apparatus and method for operating a valve 10 in a valve assembly 12 with a power wrench or nut runner tool 14 is described.

Figure 1:
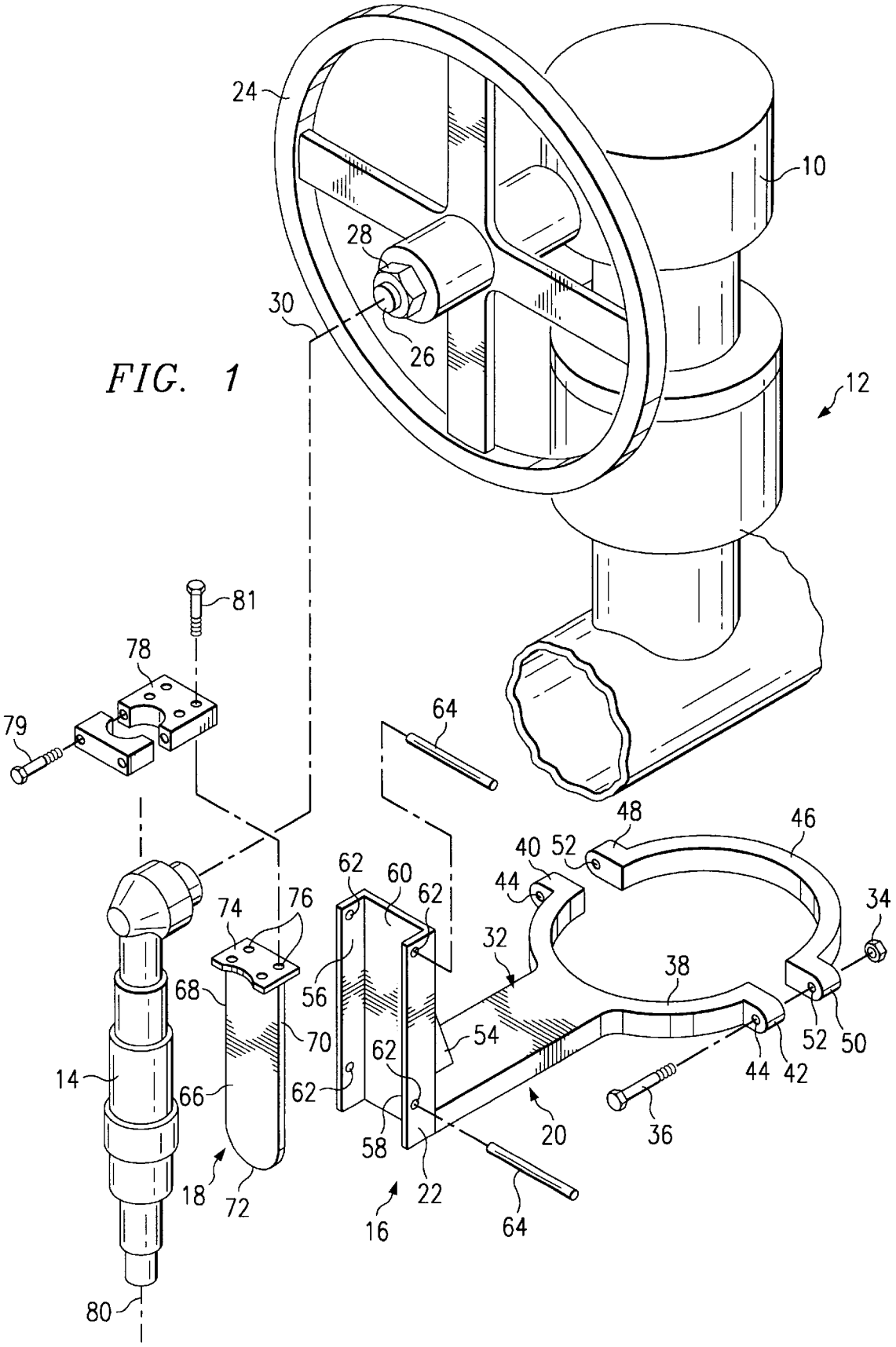
FIG. 1 is an exploded view of an apparatus forming a first embodiment of the present invention for installation on a valve assembly.
Figure 2:
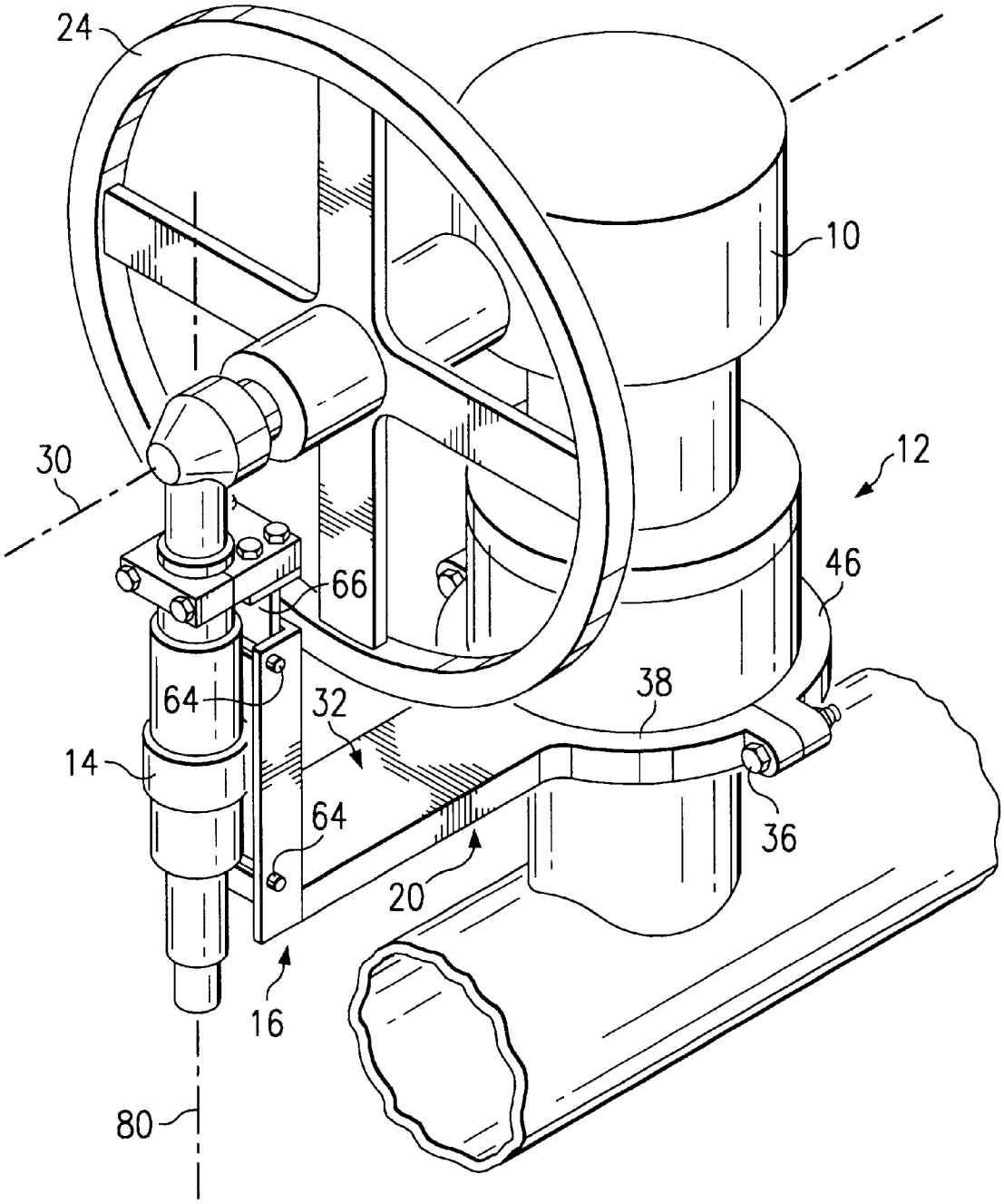
FIG. 2 is a perspective view of the apparatus of FIG. 1.

With reference to FIGS. 1–2, a torque reaction device 16 forming a first embodiment of the present invention is illustrated. The device 16 includes a torque reaction arm 18 mounted to the power wrench 14 and a torque reaction frame 20 mounted to the valve assembly 12. The wrench 14 can be pneumatically, hydraulically or electrically powered. The torque reaction frame 20 includes a U-channel 22 which limits the motion of torque reaction arm 18, and therefore power wrench 14, relative the valve assembly 12 to prevent injury to an operator, as will be described in greater detail hereinafter.

A wide variety of valve assembly configurations are encountered in industrial applications. A sample of valve assemblies are discussed herein and a number of devices constructed in accordance with the teachings of the present invention are illustrated. However, it will be understood that the principle of operation of the present invention can be applied to any valve assembly configuration by providing a suitable reaction frame for mounting on the particular valve assembly encountered.

FIGS. 1–2 illustrate a valve assembly 12 having a valve 10 with valve handle 24 secured on the valve stem 26 by a nut 28. As is conventional, the valve is open and closed by rotating the valve stem 26 about the axis 30, either by hand using the valve wheel 24 or by use of a power wrench 14 acting on the valve nut 28.

The torque reaction frame 20 includes a clamp 32 which is clamped on the valve assembly 12 by tightening nuts 34 on bolts 36. The clamp 32 has a first portion 38 with ears 40 and 42 having bolt holes 44 to receive the bolts 36 and a second portion 46 with ears 48 and 50 with bolt holes 52 facing bolt holes 44. First and second portions 38 and 46 tighten about a portion of the valve assembly 12 as shown in FIG. 2 to clamp the clamp 32 on the valve assembly. The U-channel 22 is welded, or otherwise fastened, as by bolts, rivets or the like, at the end of the first portion 38 spaced from the point where it is clamped to the valve assembly 12. Preferably, a rib 54 is welded between the U-channel 22 and the first portion 38 to stiffen the attachment of the U-channel.

The U-channel has interior facing surfaces 56 and 58 and an interior bottom surface 60. Aligned apertures 62 are formed in the U-channel 22 opening through the interior facing surfaces 56 and 58 to receive locking pins 64 for purposes to be described hereinafter. As can be readily understood, the clamping of the torque reaction frame 20 directly on the valve assembly 12 permits the torque reaction frame 20 to remain in a fixed relationship to the valve assembly 12 and valve 10 despite the thermal expansion or contraction of the valve assembly during operation.

The torque reaction arm 18 includes a blade portion 66 with parallel side edges 68 and 70 and a curved end 72. The torque reaction arm 18 further has a mounting plate 74 with suitable apertures 76 aligned with bolt patterns on a bracket 78 secured to the power wrench 14, allowing the mounting plate 74 to be rigidly secured to the power wrench 14. Bracket 78 is clamped to the power wrench 14 by bolts 79. Mounting plate 74 is bolted to bracket 78 by bolts 81. The blade portion 66 is welded to the mounting plate 74, as shown, or otherwise secured thereto as by bolts, rivets or the like. As can be seen, the torque reaction arm 18 is mounted on the power wrench 14 so that the blade portion 66 extends generally parallel the elongate axis 80 of the power wrench 14, but is spaced a distance therefrom.

Figure 2A:
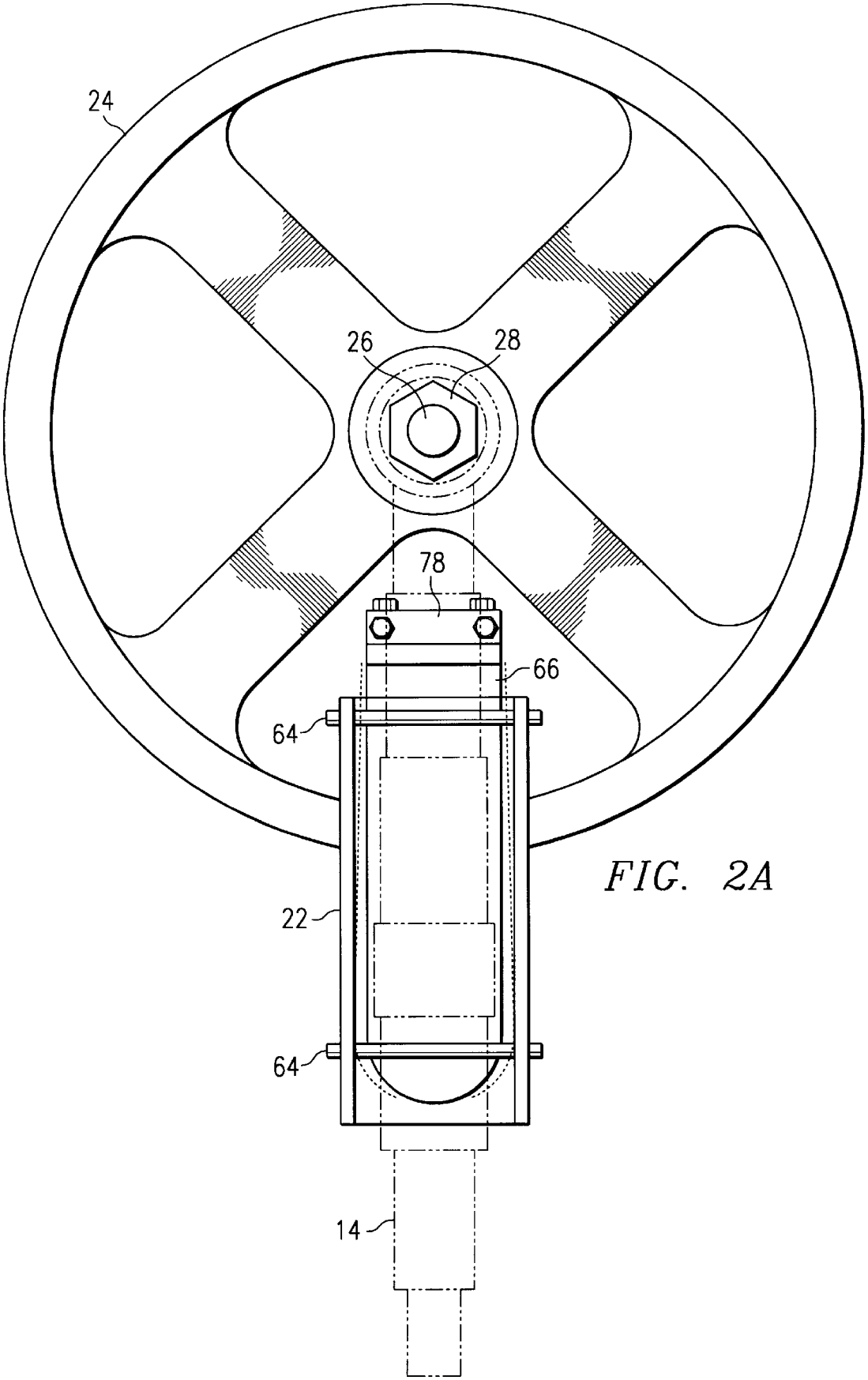
FIG. 2A is a detail view of the torque reaction arm and U-channel.

In operation, the power wrench 14 and torque reaction arm 18 are positioned for rotating the valve nut 28. In this position, the torque reaction arm 18 is within the interior of the U-channel 22 so that the edges 68 and 70 face the interior facing surfaces 56 and 58, respectively, of the U-channel, as seen in FIGS. 2 and 2A. Pins 64 are secured through the facing apertures 62 to prevent the torque reaction arm 18 from moving from the interior of the U-channel 22. For a conventional right hand rotating closing valve, as the power wrench 14 rotates the valve nut 28 clockwise as viewed from the front of the wheel to close the valve, the power wrench 14 will pivot about the axis 30 so that the parallel side edge 70 of the blade portion 66 of the torque reaction arm 18 contacts the interior facing surface 58 of the U-channel 22. When the valve reaches the limit of its travel to the closed position, the sudden impact of the valve in closing will be transmitted to the power wrench and through the torque reaction arm 18 to the U-channel 22. Thus, the operator will not be exposed to the sudden shock. While opening the valve, the opposite reaction occurs so that the parallel side edge 68 moves into contact with the interior facing surface 56 of the U-channel 22 to similarly transfer shock loading to the U-channel and torque reaction frame 20.

Figure 3:
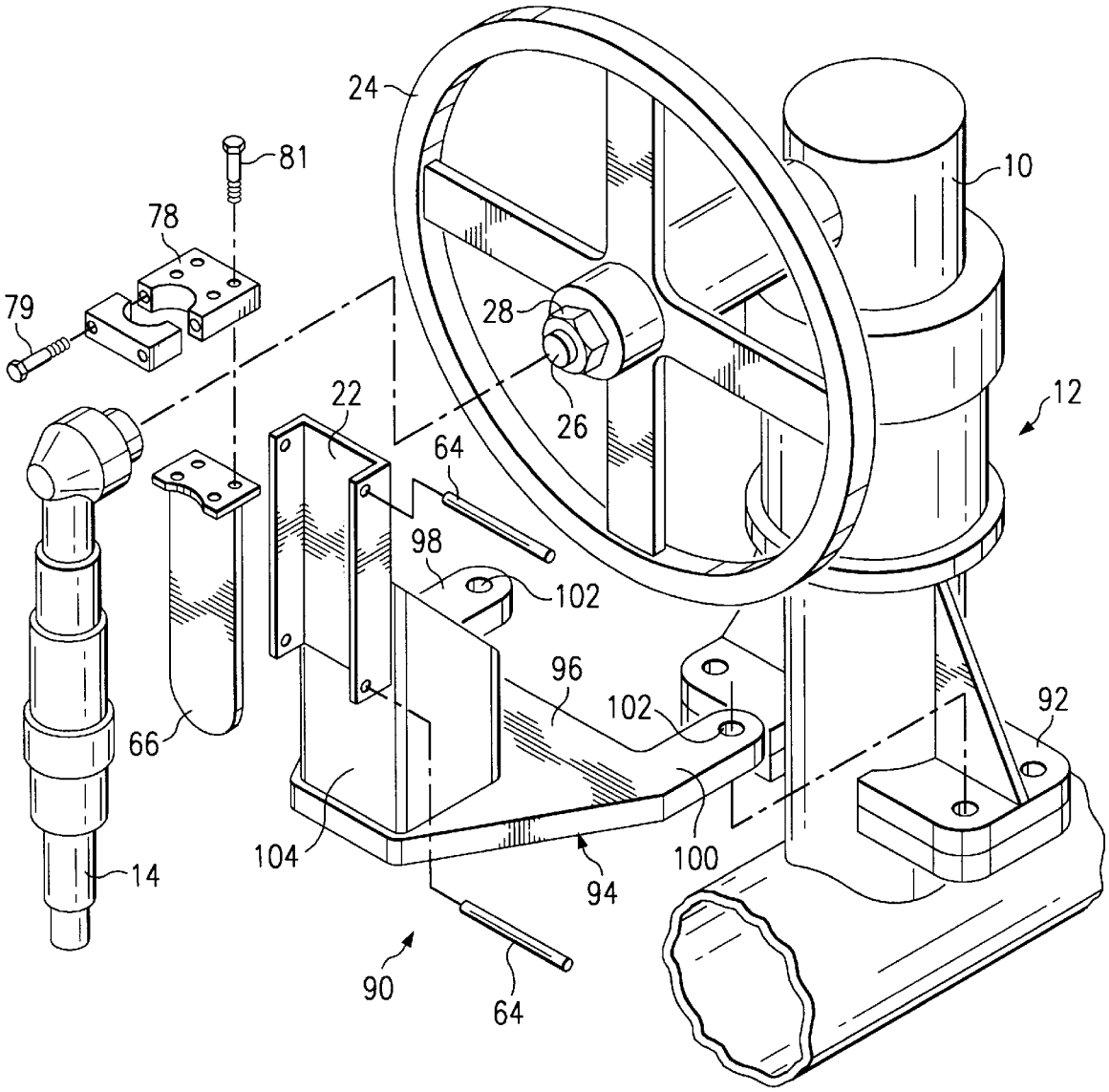
FIG. 3 is an exploded view of a modified apparatus for mounting on a bracket of the valve assembly.
Figure 4:
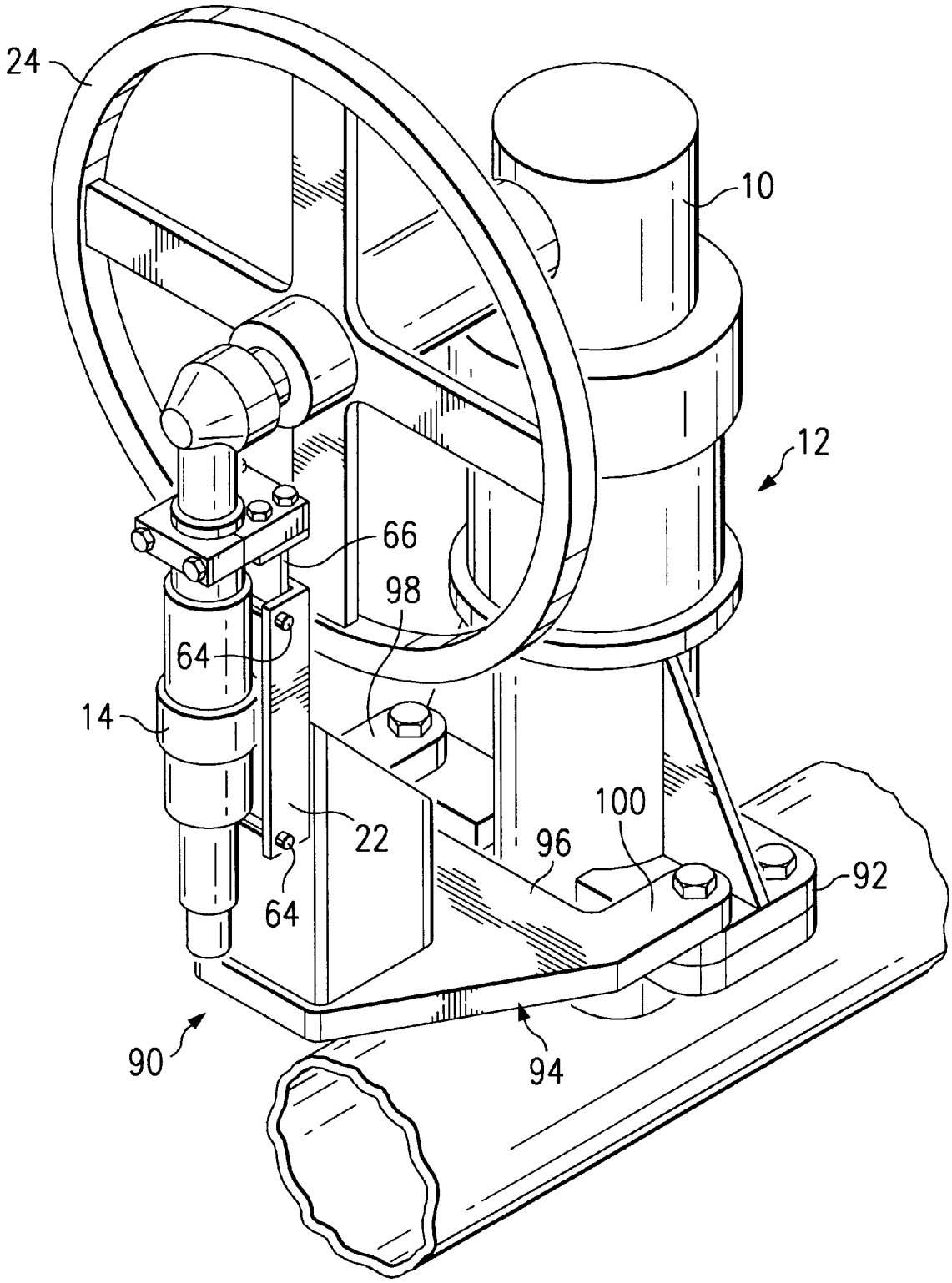
FIG. 4 is a perspective view of an apparatus of FIG. 3.

With reference to FIGS. 3 and 4, a torque reaction device 90 forming a first modification of the present invention is illustrated. Many of the elements of device 90 are identical to device 16 and are identified by the same reference numeral. The device 90 can be employed when valve assembly 12 has a bolted flange 92, as seen in FIGS. 3 and 4. The torque reaction frame 94 is formed of a bracket 96 which has arms 98 and 100 having apertures 102 for bolting directly onto the bolted flange 92 of the valve assembly 12. Square tubing 104 is welded to the bracket 96, or otherwise secured thereto, such as by bolts or rivets. The U-channel 22 is secured to the square tubing 104 as by welding, bolting, riveting or the like. The torque reaction device 90 works in a manner identical to the torque reaction device 16.

Figure 5:
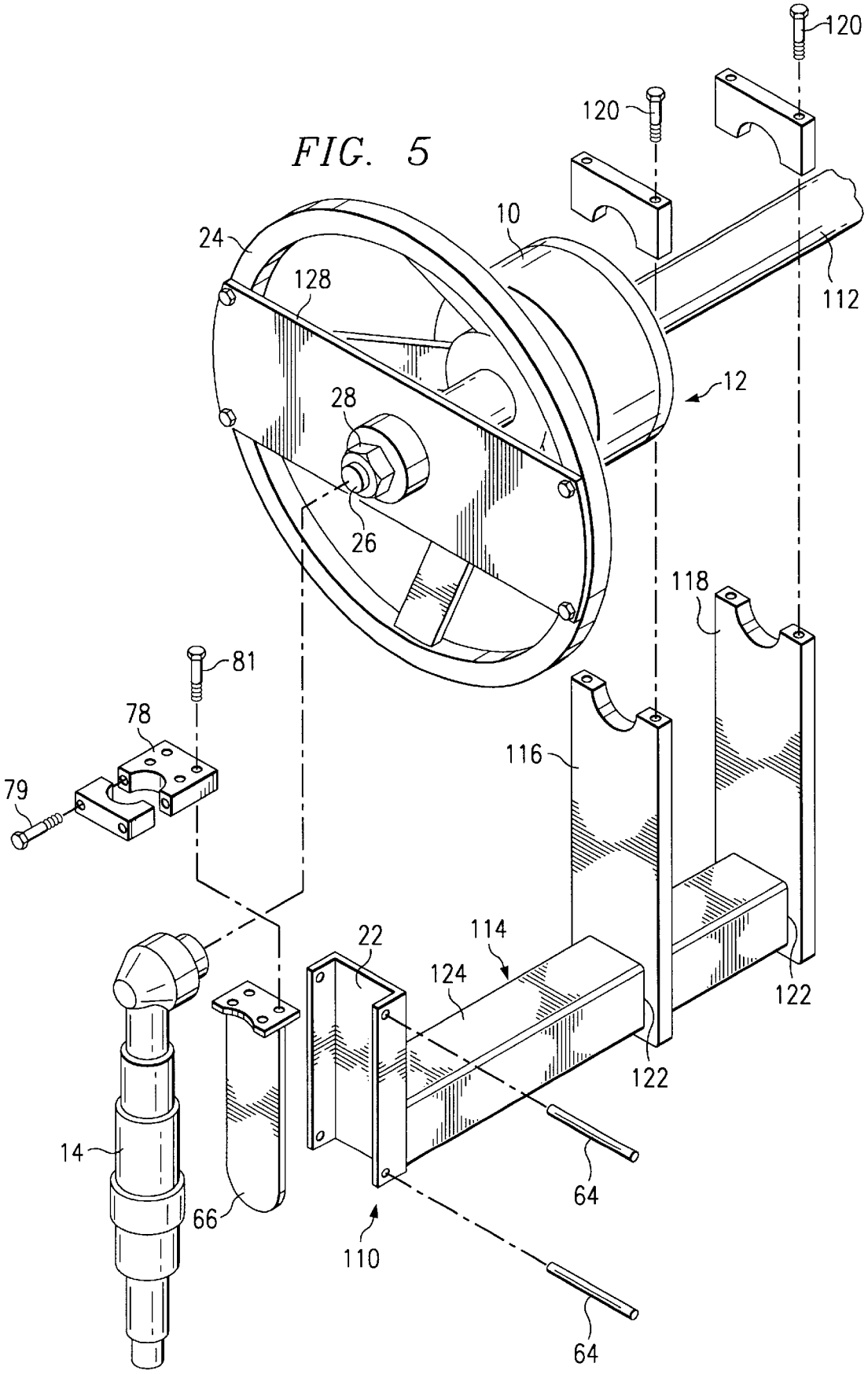
FIG. 5 is an exploded view of a modification of the apparatus mounted to a pipe section on the valve assembly.
Figure 6:
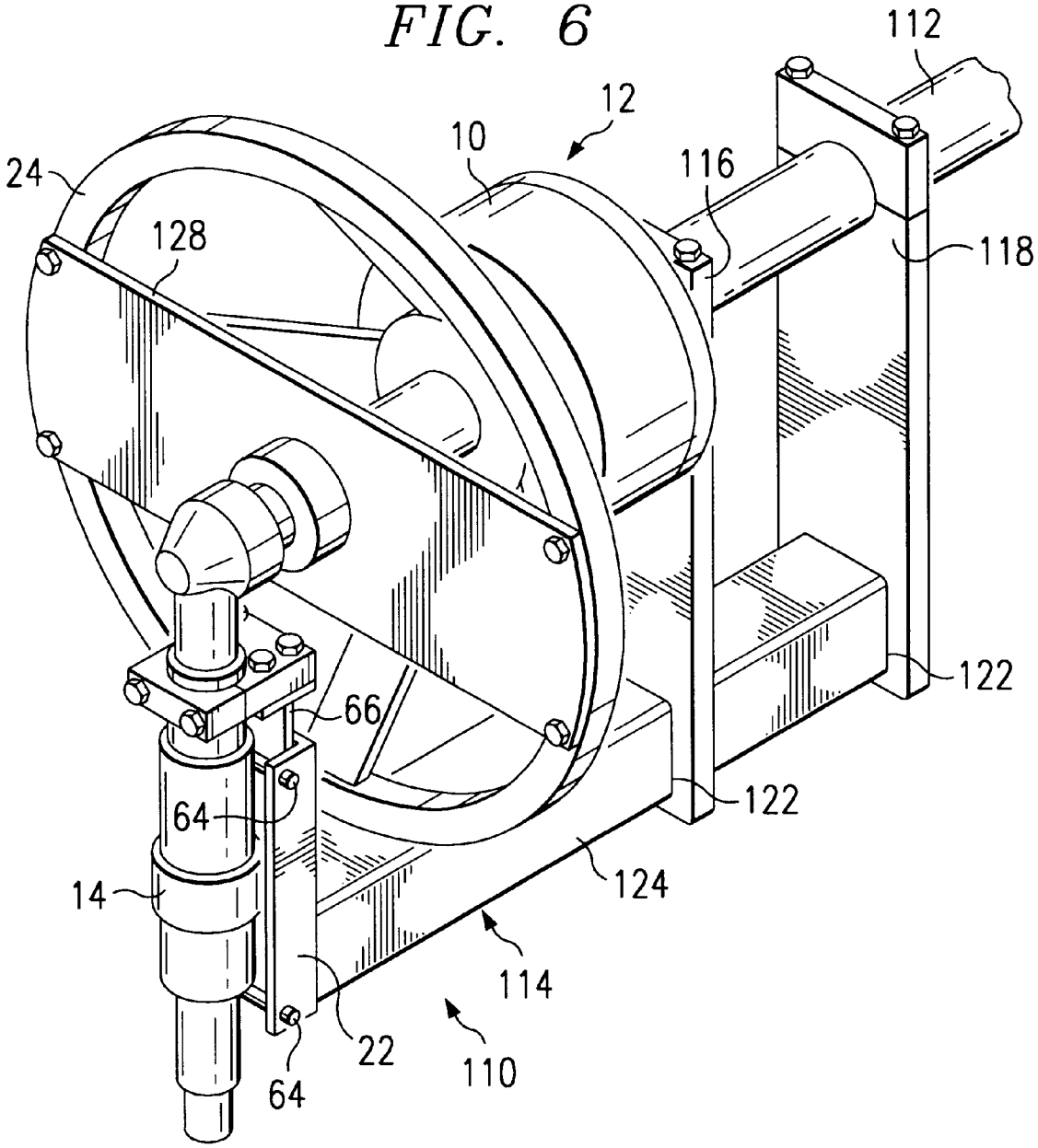
FIG. 6 is a perspective view of the apparatus of FIG. 5.

With reference now to FIGS. 5 and 6, a torque reaction device 110 forming a second modification of the present invention is disclosed. Again, many portions of the device 110 are identical to device 16 and are identified by the same reference numeral. The device 110 is employed with a valve assembly 12 which has a pipe section 112 of generally uniform outer diameter. The torque reaction frame 114 of device 110 includes parallel clamps 116 and 118 to clamp to the exterior of the pipe section 112 at two separate locations. Each clamp 116 and 118 is clamped to the pipe section 112 by suitable bolts 120. At the ends of the clamps opposite the pipe section there are formed square apertures 122 therethrough to receive a square tube 124. The square tube 124 is secured to the clamps 116 and 118 by welding, bolting, riveting or the like. The U-channel 22 is mounted at an end of the square tube 124, again by welding, bolting, riveting or the like. A fabricated drive wheel 128 can be secured to valve handle 24, as shown.

Figure 7:
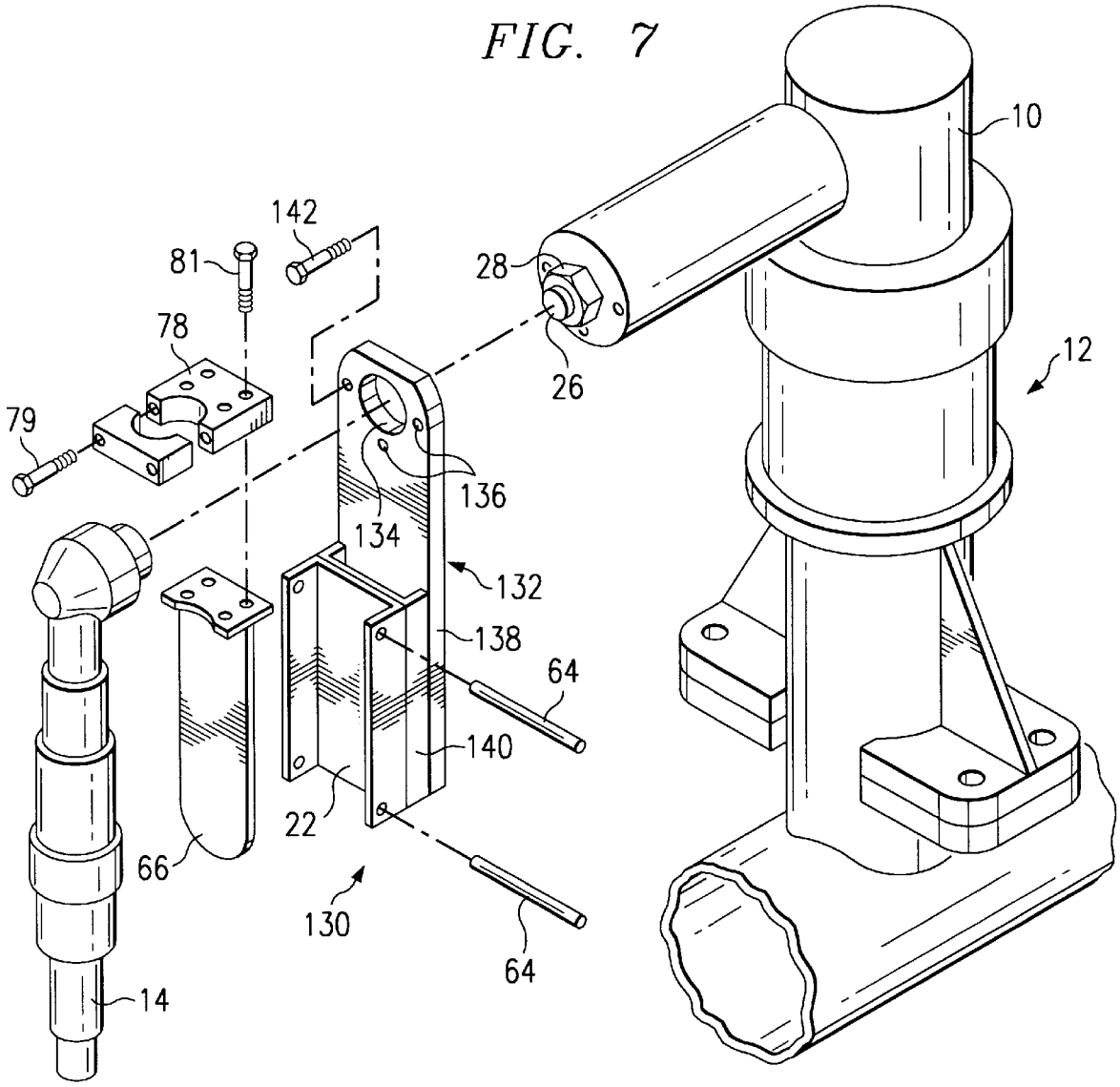
FIG. 7 is an exploded view of a modified apparatus with the frame member mounted on the valve.
Figure 8:
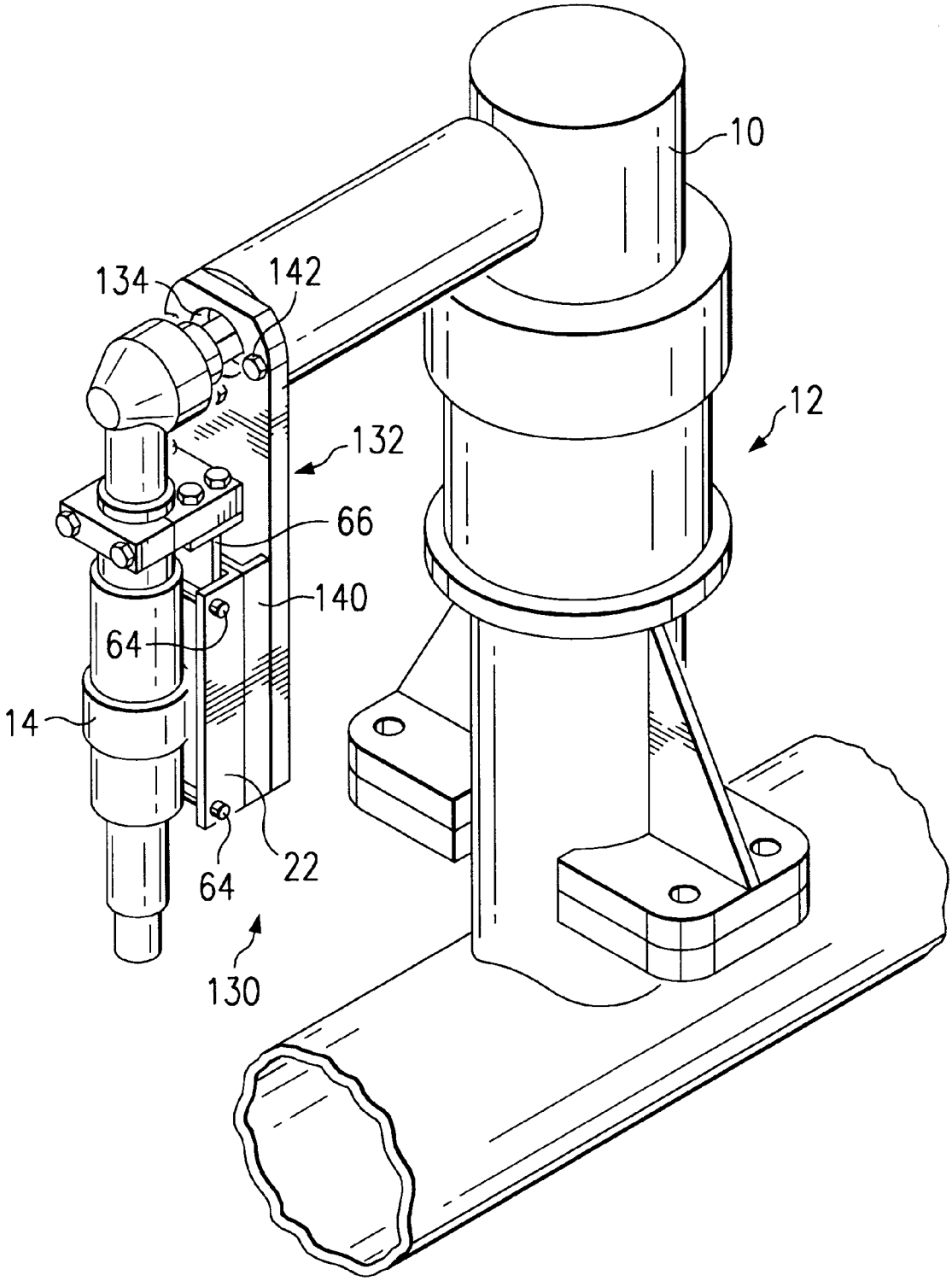
FIG. 8 is a perspective view of the apparatus of FIG. 7.

With reference to FIGS. 7 and 8, a torque reaction device 130 forming a third modification of the present invention is illustrated. Again, identical elements in device 130 are identified by the identical reference numerals as device 16. The device 130 is used with a valve assembly 12 which is configured so that the torque reaction frame 132 mounts directly on the valve 10 about the valve stem 26 where no valve handle 24 is used. The frame 132 includes a plate 138 which has an aperture 134 for passage of the valve stem and bolt apertures 136 to bolt the frame 132 to the valve 10 with bolts 142. At the end of plate 138 spaced from the valve is mounted an inverted U-channel 140 by welding, bolting, riveting or the like. The U-channel 22 is secured to the U-channel 140 by welding, bolting, riveting or the like.

Figure 9:
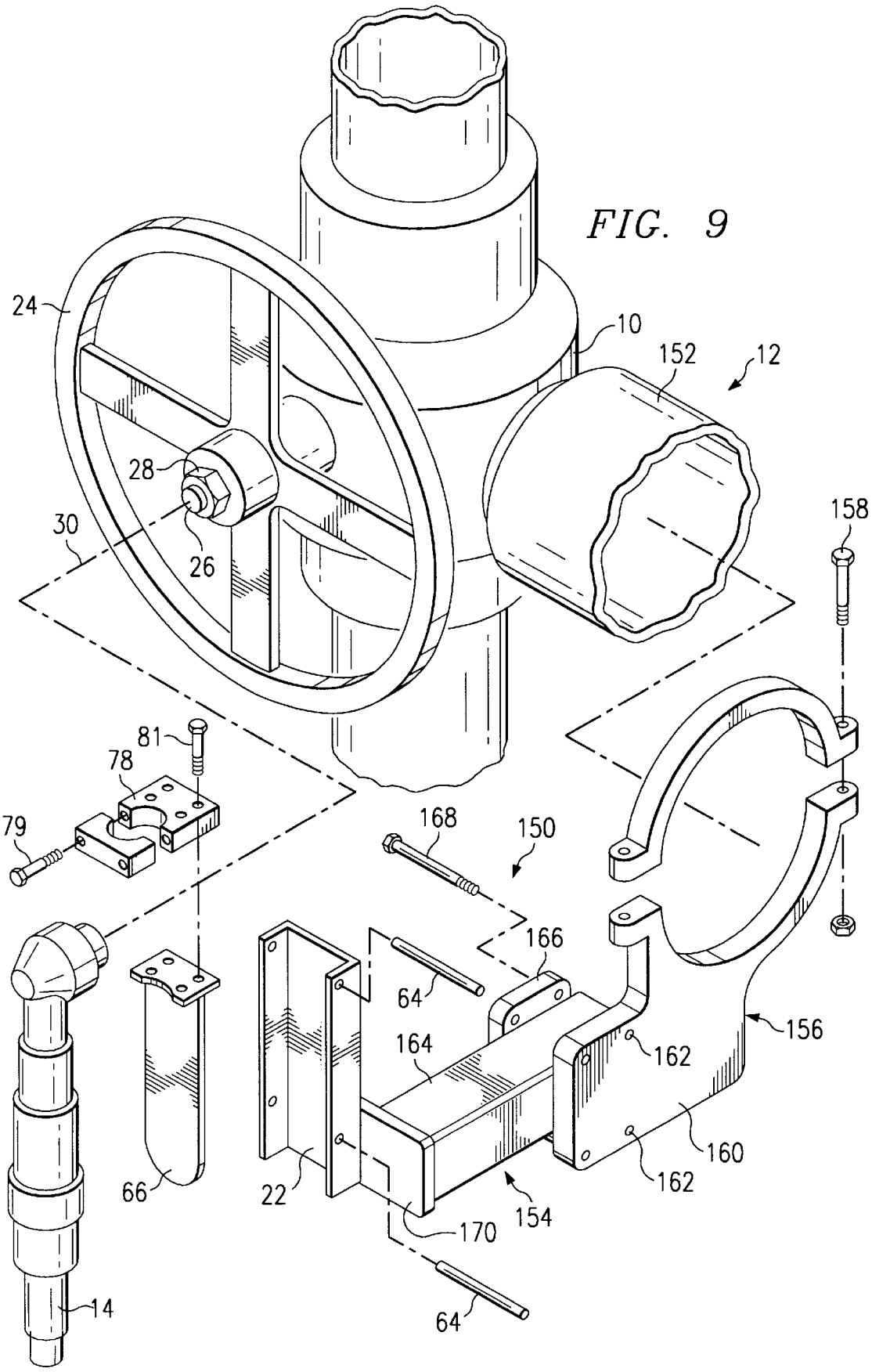
FIG. 9 is an exploded view of a modified apparatus mounted on a valve assembly having a horizontal pipe section.
Figure 10:
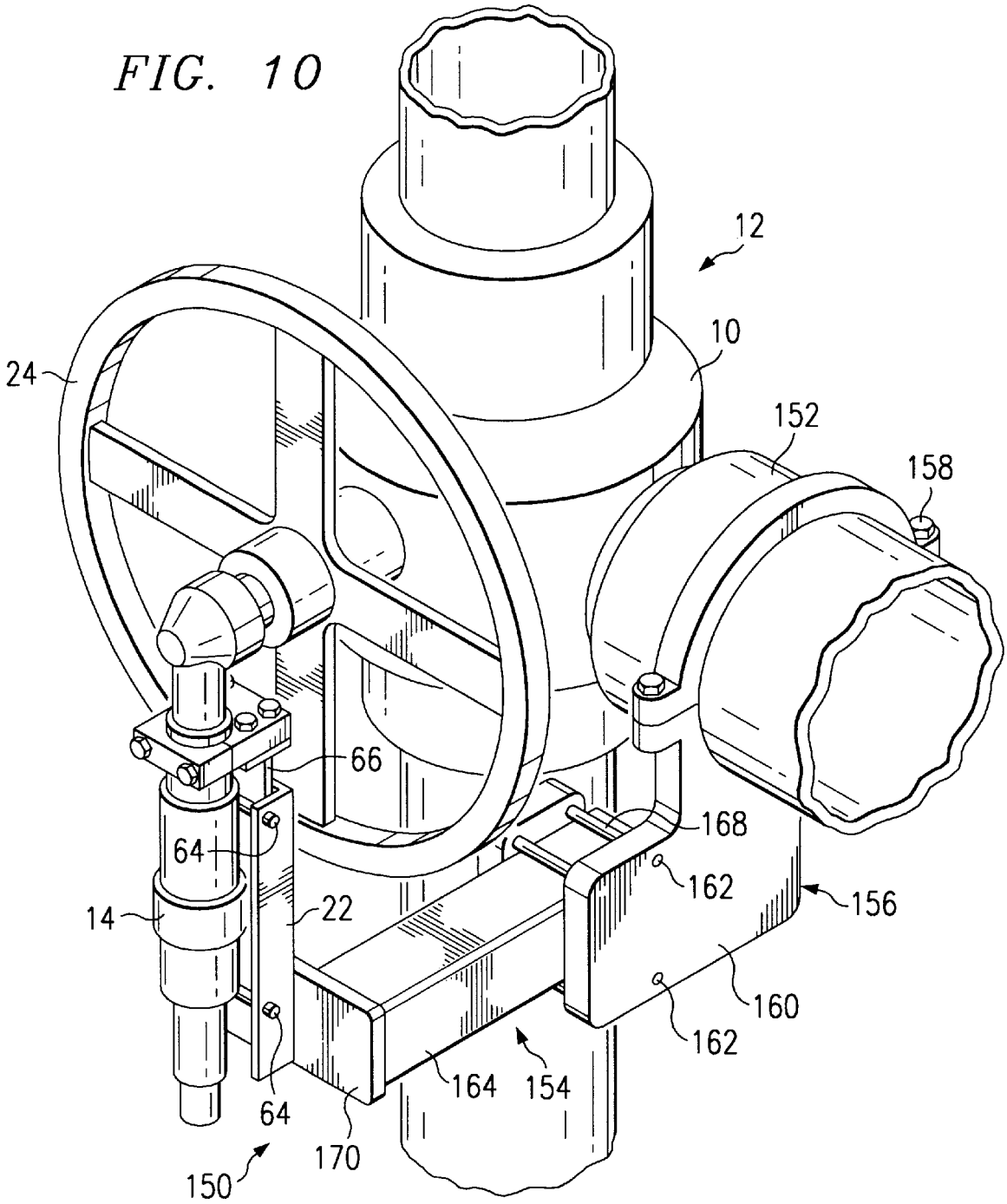
FIG. 10 is a perspective view of an apparatus of FIG. 9.

With reference to FIGS. 9 and 10, a torque reaction device 150 forming a fourth modification of the present invention is illustrated. Again, identical elements in device 150 are identified by identical reference numerals as in device 16. The device 150 is used in a valve assembly 12 having a pipe section 152. The torque reaction frame 154 has a clamp 156 which is clamped to the pipe section 152 by bolts 158. A portion 160 of the clamp 156 has a series of four bolt holes 162, preferably threaded. A square tubing 164 is bolted to portion 160 by a plate 166 and bolts 168. A second plate 170 is welded, bolted, riveted or otherwise secured to an end of the square tubing 154 which, in turn, mounts the U-channel 22 thereon by welding bolting, riveting, or the like. One advantage of the device 150 is bolting square tubing 164 to the clamp 156 permits adjustment of the position of the square tubing 164 relative clamp 156. This permits the installer to adjust the position of the u-channel 22 relative to the valve 10 in a direction generally parallel to the axis 30 as the device 150 is installed.

As will be understood, the invention provides a lightweight and low cost, yet effective apparatus for and method of safely controlling the rotational torque of a power wrench when utilized in operating valves in industrial sites such as process plants. The torque reaction arm is a small, lightweight member which is preferably attached to the power wrench itself without need to modify the wrench. By directly mounting the torque reaction frame on the valve assembly, the frame movement follows the piping of the valve assembly when thermal expansion of the piping system is encountered. By use of varied frame designs, the frame can be custom adapted to the valve configuration encountered.

While the invention has been described herein relative to an embodiment including a number of modifications, it is understood that alternatives and variations realizing the advantages and benefits of this invention will be apparent to those of ordinary skill in the art having reference to this specification and its drawings. It is contemplated that such alternatives and variations are within the scope of this invention as subsequently claimed herein, and it is intended that the scope of this invention claimed herein be limited only by the broadest interpretation of the appended claims to which the inventors are legally entitled.

I claim:

1. A torque reaction apparatus for use with a power wrench and a valve assembly wherein said valve assembly includes a valve which is adjustable, said torque reaction apparatus comprising:

a frame member comprising at least one surface positioned on said frame member wherein said frame member is configured for attachment to the valve assembly; and an arm member configured for attachment to the power wrench wherein said arm member is configured for releasable contact to said frame member such that said at least one surface of said frame member restricts rotational movement with respect to the valve assembly.

2. An apparatus according to claim 1 wherein said frame member has two of said surfaces and defines a U-channel, having a first said surface and a second said surface.

3. An apparatus according to claim 2 wherein said arm is configured to be attached to the power wrench in a spaced apart manner and defines a first edge and second edge.

4. An apparatus according to claim 2 further comprising at least one locking pin received in the U-channel to confine the arm member within the U-channel.

5. An apparatus according to claim 4 wherein said arm member is configured such that when said arm member is attached to the power wrench, said arm member is spaced apart from said power wrench and extends in a direction parallel to a longitudinal axis of said power wrench.

6. An apparatus according to claim 1, further comprising at least one locking pin attached to said frame member wherein said locking pin confines said arm member in a relation to maintain said arm in close association with said frame.

7. An apparatus according to claim 1 wherein said frame member further comprises a bracket for bolting said frame member to a valve assembly.

8. An apparatus according to claim 5 wherein said arm member is configured such that when said arm member is attached to the power wrench, said arm member is spaced apart from said power wrench and extends in a direction parallel to a longitudinal axis of said power wrench.

9. An apparatus of claim 1 wherein said arm member is a bar having a first edge, said first edge configured such that it is capable of moving into contact with said at least one surface on said frame member.

10. An apparatus of claim 1 wherein said arm is configured for attachment to the power wrench such that said arm will extend parallel to the elongate length of the power wrench and spaced apart from the power wrench.

11. A method for adjusting a valve in a valve assembly comprising the steps of:

attaching an arm member to a power wrench;

attaching a frame member to the valve assembly wherein said frame member comprises a first surface and a second surface which are positioned on said frame member so as to define a U-channel;

releasably contacting said arm member with said frame member such that said power wrench is releaseably coupled to said valve and such that said first and second surfaces of said frame member restrict rotational movement of said power wrench with respect to said valve assembly; and adjusting said valve by applying a torque from said power wrench to said valve.

12. A method according to claim 11 further comprising the step of securing said arm member within said frame member with at least one locking pin configured for releasably coupling with said frame member.

13. A method according to claim 11 further comprising the step of clamping the frame member on the valve assembly with a clamp.

14. A method according to claim 11 further comprising the step of mounting the frame member on the valve assembly by bolting the frame member to the valve assembly.

15. A method according to claim 11 further comprising the step of clamping the frame member to a cylindrical portion of the valve assembly with a plurality of clamps.

16. A method according to claim 11 further comprising the step of securing the frame member to the valve in the valve assembly.

17. A method according to claim 11 wherein the step of attaching the arm member to the power wrench is performed without modifying the power wrench.

* * * * *

UNITED STATES PATENT AND TRADEMARK OFFICE

CERTIFICATE OF CORRECTION

PATENT NO. : 6,244,138 B1
DATED : June 12, 2001
INVENTOR(S) : Peter Joseph Campbell It is certified that error appears in the above-identified patent and that said Letters Patent is hereby corrected as shown below:

Column 6,
Lines 1-5, after "8.", delete "An apparatus according to claim 5 wherein said arm member is configured such that when said arm member is attached to the power wrench, said arm member is spaced apart from said power wrench and extends in a direction parallel to a longitudinal axis of said power wrench.", and insert -- An apparatus according to claim 1 wherein said frame member further comprises a plurality of clamps for clamping said frame member to a cylindrical portion of the valve assembly. --

Signed and Sealed this

Thirtieth Day of April, 2002

*Attest:*

*Attesting Officer*

JAMES E. ROGAN
*Director of the United States Patent and Trademark Office*